US008402874B2

(12) United States Patent
Herrmann et al.

(10) Patent No.: US 8,402,874 B2
(45) Date of Patent: Mar. 26, 2013

(54) DRIVE AND QUICK STOP FOR A WEAPON WITH PREFERABLY LINEAR BREECH OR AMMUNITION FEED

(75) Inventors: Ralf-Joachim Herrmann, Senzig (DE); Klaus Lawitzke, Magdeburg (DE); Heiner Schmees, Celle (DE); Berthold Baumann, Eschede (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 16 days.

(21) Appl. No.: 13/154,108

(22) Filed: Jun. 6, 2011

(65) Prior Publication Data

US 2011/0290103 A1 Dec. 1, 2011

Related U.S. Application Data

(63) Continuation-in-part of application No. PCT/EP2009/007976, filed on Nov. 7, 2009.

(30) Foreign Application Priority Data

Dec. 4, 2008 (DE) ..... 10 2008 060 215

(51) Int. Cl.
*F41A 3/00* (2006.01)

(52) U.S. Cl. ..... 89/20.4; 89/18

(58) Field of Classification Search ..... 42/2–49.1; 89/125–199, 9–13.1, 17–26
See application file for complete search history.

(56) References Cited

U.S. PATENT DOCUMENTS

| | | | | |
|---|---|---|---|---|
| 430,206 | A | 6/1890 | Garland | |
| 475,276 | A | 5/1892 | Garland | |
| 2,378,191 | A * | 6/1945 | Corte | 89/33.16 |
| 3,503,300 | A | 3/1970 | Dardick | |
| 3,834,272 | A * | 9/1974 | Patenaude et al. | 89/12 |
| 4,154,142 | A | 5/1979 | Schwegler | |
| 4,301,709 | A * | 11/1981 | Bohorquez et al. | 89/11 |
| 4,481,858 | A | 11/1984 | Price | |
| 4,563,936 | A * | 1/1986 | Cleary et al. | 89/11 |

(Continued)

FOREIGN PATENT DOCUMENTS

| | | | |
|---|---|---|---|
| CH | 675 767 | A5 | 10/1990 |
| DE | 70 863 | C | 9/1893 |

(Continued)

OTHER PUBLICATIONS

International Search Report issued in International Application No. PCT/EP2009/07974, completed Jan. 29, 2010 and mailed Feb. 10, 2010.

(Continued)

*Primary Examiner* — Samir Abdosh
(74) *Attorney, Agent, or Firm* — Griffin & Szipl, P.C.

(57) ABSTRACT

A drive for a breech/breech carrier renders it axially adjustable relative to a weapon barrel. The drive includes a motor, two engaging cams mounted on a chain arranged below the breech and guided around two sprocket wheels. A slide is mounted in a guide at the bottom of the breech/breech carrier so as to move at a right angle to the direction of fire, with a groove extending over its entire width. The respective engaging cam entrains the breech in forward motion relative to the direction of fire, or in reverse motion, once the shot is fired, and transports the breech forwards, is displaced from the groove, and moves backwards without the breech, thereby allowing breech rest periods in a forward position. During firing, the slide moves, whereas it remains stationary when no shot is fired so no further engaging cam can entrain the breech backwards.

12 Claims, 3 Drawing Sheets

U.S. PATENT DOCUMENTS

| | | | | |
|---|---|---|---|---|
| 4,686,886 | A * | 8/1987 | Caserza et al. | 89/11 |
| 5,134,922 | A | 8/1992 | Menges et al. | |
| 5,353,678 | A | 10/1994 | Rochelle et al. | |
| 6,009,791 | A * | 1/2000 | Medlin | 89/38 |
| 2011/0314996 | A1 * | 12/2011 | Herrmann et al. | 89/17 |
| 2012/0132061 | A1 | 5/2012 | Herrmann et al. | |

FOREIGN PATENT DOCUMENTS

| | | | |
|---|---|---|---|
| DE | 30 21 200 | | 12/1980 |
| DE | 32 16 813 | A1 | 11/1983 |
| DE | 32 18550 | A1 | 11/1983 |
| DE | 37 12 905 | A1 | 11/1988 |
| DE | 36 27 361 | C1 | 4/1992 |
| DE | 10 2006 022 622 | A1 | 11/2007 |
| DE | 10 2007 048 468 | A1 | 4/2009 |
| DE | 10 2007 048 470 | A1 | 4/2009 |
| DE | 10 2005 045 824 | B3 | 5/2009 |
| DE | 10 2007 054 470 | A1 | 5/2009 |
| EP | 1 767 891 | A1 | 3/2007 |
| FR | 538 190 | A | 6/1922 |
| GB | 577 338 | | 5/1946 |
| JP | 6-159991 | | 6/1994 |
| JP | 7-139896 | | 6/1995 |
| JP | 7-174491 | | 7/1995 |
| WO | 2009/049723 | A1 | 4/2009 |
| WO | 2009/062585 | A1 | 5/2009 |

OTHER PUBLICATIONS http://www.knightswoodsecondary.org.uk/personal/Resources/Hillhead/Credit_Worksheets/CompositeAreas.pdf; downloaded May 29, 2011.

International Search Report, issued in International Application No. PCT/EP2009/07975, completed Jan. 29, 2010 and mailed Feb. 10, 2010.

International Search Report issued in International Application No. PCT/EP2009/007977, completed Jan. 29, 2010, mailed Feb. 10, 2010.

http://en.wikipedia.org/wiki/M242_Bushmaster, M242 Bushmaster—Wikipedia, the free encyclopedia, downloaded May 9, 2011, pp. 1-7.

International Search Report issued in corresponding International Application No. PCT/EP2009/007976, completed Jan. 29, 2010, mailed Feb. 9, 2010.

* cited by examiner

DRIVE AND QUICK STOP FOR A WEAPON WITH PREFERABLY LINEAR BREECH OR AMMUNITION FEED

This is a Continuation-in-Part Application in the United States of International Patent Application No. PCT/EP2009/007976 filed Nov. 7, 2009, which claims priority on German Patent Application No. DE 10 2008 060 215.9, filed Dec. 4, 2008. The entire disclosures of the above patent applications are hereby incorporated by reference.

FIELD OF THE INVENTION

The present invention pertains to a drive provided with a quick stop device for a breech, or breech support, which can be moved in the axial direction with respect to a weapon barrel of a weapon, wherein the drive has a motor, or the like, and is provided with a chain that is driven by the motor and to which at least two driver studs are fitted.

BACKGROUND OF THE INVENTION

Various drives, such as external drives or self-drives, for weapon systems are known from the prior art. Electrical drives are frequently provided as external drives for this purpose, and these then, for example, drive a chain. One known chain drive is used in the machine gun known by the name "Bushmaster," or else chain gun. In this case, the times during which the breech has to be stationary for closing it, in order to fire the shot, and in order to open the breech and to place a cartridge in front of the breech, are implemented by a revolving chain that is driven by a motor (See, e.g., de.wikipedia.org/wiki/M242Bushmaster). In this case, the breech, together with the round or cartridge in front of it, is fed linearly to the cartridge chamber.

DE 10 2006 022 622 A1 describes a linear feed for the round into a weapon barrel or cartridge chamber, which feed has a control guide, which is used for function control, on the horizontal plane parallel to the movement of a breech, which has to be guided linearly, for the breech-loading weapon. This functionally interacts with a so-called "drive guide," which is likewise located on the horizontal plane, for guiding a means connected to the breech. The drive guide is integrated in a movable slider, which is itself moved by a universally configurable drive. Furthermore, a locking guide is provided for locking the breech, and is preferably integrated in the movable slider together with the drive guide. A bolt on a locking ring, which is preferably arranged on the weapon side, can engage in this locking guide. This bolt then itself moves the locking ring. Within the control guide and the drive guide, which interact with one anther, a connecting rod or the like is positively guided by the guides, and by the slider along these guides. The breech is moved backward and forward by means of this connecting rod.

Building on this, DE 10 2007 048 468.4, which was not published prior to the earliest priority date for this application, considers in more detail a drive for the linear feed of the round into a weapon barrel, or cartridge chamber, by means of a chain. The chain itself is passed in a simple manner closely around two sprocket wheels. A chain link, or a stud on the chain, is integrated in a guide or groove that is located underneath the movable slider. This allows the chain to continue to run during the times in which the weapon is stationary, and which is defined by the function control. The chain itself can be driven by an electric motor.

Since, in the case of an external drive, the breech movements take place independently of the gas pressure in the weapon barrel, it is necessary to prevent the breech from being opened in the event of a misfire (i.e., the propellant charge in the cartridge does not burn away after the firing energy has been supplied) or a late fire (i.e., in this case, the propellant charge burns away with a considerable time delay). In general, the gas pressure or the weapon barrel itself is, for this purpose, detected as an indication of correct burn-away. If this information is lacking, a so-called "quick stop" must be initiated, and the opening of the breech must be prevented.

The mass forces during breaking of the external drive, in order to prevent opening of the breech, result in high loads in or on the elements of the drive train, particularly, at relatively high firing rates of the weapon.

DE 10 2007 048 470.6, which was also not published prior to the earliest priority date of this application, deals with the problem of a so-called quick stop in externally driven weapons. The quick stop is inserted all the time, and is Moved out again when a shot is fired correctly. However, in the event of a misfire, a means that is functionally connected to the weapon recoil runs onto the quick stop, the drive movement is stopped, and the breech is not unlocked, at least for a predeterminable time.

DE 30 21 200 C2, which also published as U.S. Pat. No. 4,301,709, discloses a protection system against late firing or subsequent firing. U.S. Pat. No. 4,301,709 is incorporated herein for all that it discloses. In addition to having a sensor for detection of recoil, the weapon disclosed by DE 30 21 200 C2 and U.S. Pat. No. 4,301,709 is equipped with a quick stop that can be moved to a position pushed in with respect to the chain part, in order to stop a normally continuously moving chain part, and, therefore, to stop the movement of the breech. A locking apparatus, which responds to the sensor, controls the movement of the stopping apparatus between the pushed-in position, in which the chain part is stopped, and an extended position, in which the movement of the chain part is otherwise not impeded. The protection system has two elements, which are connected to the chain part, namely, a main element and a safety element, as well as a trigger rod that is controlled by a solenoid, and a recoil push rod. The recoil push rod is used to release a recoil catch bolt when the shot is fired, and the trigger rod is used to move the safety element down when the weapon is locked and to release it when the round has been correctly fired. In order to subsequently stop the weapon, the trigger rod acts on the main element, since the solenoid is switched off. However, an electrically controlled solenoid, such as this one, is particularly undesirable in safety devices of this type because it is itself susceptible to defects. The possibility of the material of the rods fracturing furthermore means that the safety device is not functionally reliable. In addition, the design of the entire unit is very complex.

DE 32 18 550 C2 discloses a blocking device for a machine gun having an externally driven breech drive. In this case, energy, which results from the shot firing, is used for a shot monitoring device to interrupt the external power supply. When a shot is not fired and there is no return movement, this prevents a control stud of the device from being moved out of a pulled-back position to a driving position, while a switching lever is transported by an interrupter stud to a position in which the power supply is continuously restricted. The disadvantage of this solution is, likewise, the high level of design complexity, and the weight associated with this complexity.

The purpose of the present invention is to specify a drive for feeding the weapon breech to the cartridge chamber, in which the breech is automatically decoupled from the drive, particularly in the event of a misfire or a late fire.

SUMMARY OF THE INVENTION

The object is achieved by the features of a first embodiment of the invention, which pertains to a drive provided with a quick stop device for a breech (3), or breech support, which can be moved in the axial direction with respect to a weapon barrel (1), having a motor or the like, with a chain (6) that is driven by the motor and to which at least two driver studs (7) are fitted, wherein the drive has the following features: (a) at least two sprocket wheels (5) are preferably arranged underneath the breech, around which sprocket wheels the chain (6) with the driver studs (7) is passed, (b) a slide (8) is mounted in a guide at the bottom on the breech (3), or the breech support, such that it can move transversely with respect to the firing direction, and a groove (9) extends over the entire width of this slide, wherein the respective driver stud (7) moves the breech (3) via this groove (9), forward in the firing direction or backward after the shot, wherein the times in which the breech (3) is stationary in the front limit position are implemented in that the driver stud (7), which transports the breech (3) forward, is moved out of the groove (9) and is moved backward on the other weapon side without the breech (3), and when a shot has been fired, the slide (8) is moved to the other weapon side, while it remains in its position in which it has been moved away from the driver stud (7) when no shot has been fired, such that no further driver stud (7) can drive the breech (3) to the rear. Advantageous additional embodiments are summarized as follows.

In accordance with a second embodiment of the present invention, the first embodiment is modified so that one of the sprocket wheels (5) is driven by the motor (30), or the like, directly or indirectly, and drives the chain (6). In accordance with a third embodiment of the present invention, the first embodiment or the second embodiment is further modified so that the breech (3) is accelerated or braked by means of a sinusoidal function, which is predetermined by the radius of the sprocket wheels (5). In accordance with a fourth embodiment of the present invention, the first embodiment, the second embodiment, and the third embodiment are further modified so that a lever (10) moves the slide (8) to its left-hand position, and in the process stresses a compression spring (16).

In accordance with a fifth embodiment of the present invention, the first embodiment, the second embodiment, the third embodiment, and the fourth embodiment, are further modified so that a recoil movement of the weapon barrel (1) is used, which acts on a barrel lock (2), which itself drives a pin (13), which is arranged such that it can be moved in the longitudinal direction together with a plunger (12), in a bearing block (11) that is fixed to the weapon housing (40). In accordance with a sixth embodiment of the present invention, the fifth embodiment is further modified so that a spring is included between a sleeve, in which the pin (13) is mounted, and the plunger (12). In accordance with a seventh embodiment of the present invention, the fifth embodiment and the sixth embodiment are further modified so that a linkage (15) is moved by the rear edge of the barrel lock (2) during weapon recoil, and rotates the lever (10), thus removing a lock from the slide (8), which holds the slide (8) in its right-hand or left-hand position, in its rest position, by means of a tab.

The invention is likewise based on the idea of integrating a chain as a drive. The rotary movement of the external drive, for example, an electric motor, is converted via the chain drive to a forward and backward movement of the breech. The chain has at least two driver studs. In order to allow the times for which the breech is stationary in the limit positions, the breech is disconnected from the driver studs, and, therefore, from the drive in its front and rear positions.

The sprocket wheels, which drive the chain themselves, have a radius that accelerates or brakes the breech on the basis of a sinusoidal function, which is produced in this way. The at least two driver studs on the chain engage in a slide with a groove under the breech, or the breech holder, in order to drive it. During the times when the breech is stationary, the driver studs each leave the groove. The slide itself is introduced into a guide under the breech and can be moved in this guide. It is preferable that the slide is only half as wide as the chain drive. In this case, the slide occupies only a part of the overall guide, and can, therefore, be moved to and fro in this guide transversely with respect to the firing direction. The slide is pressed by a spring, or the like, against the right-hand side, in the firing direction, of the breech or the breech holder, so that one driver stud on the chain engages in the groove in the slide on its forward path in the firing direction. As the chain drive continues to run, this driver stud on the chain moves back again on the left-hand side of the weapon system and, in the process, leaves the groove in the slide, as a result of which the breech remains in its foremost, locked position, independently of the drive. After a shot has been fired, the slide itself is moved from its right-hand position (seen in the firing direction) to its left-hand position within the guide. This is done using weapon recoil or, alternatively, gas pressure. This means that the weapon recoil, which follows the firing of the cartridge, moves the slide to the left-hand side of the breech or of the weapon system, where it is held by a lever etc. The second driver stud on the chain is now itself moved from the right-hand side into the groove in the slide, and drives the breech to its rear position. Here, the driver stud leaves the groove again, thus starting the rear waiting time of the breech. When the cartridge is placed in front of the breech by a feed, or the like, the slide is forced to the right-hand side again, under the breech, by releasing the (hold-down) lever from the spring. The next driver stud on the chain is now moved from the left-hand side into the groove in the slide, and drives the entire system forward again. If no shot is fired, the slide remains in its right-hand position, and the second or subsequent driver stud cannot unlock the breech, and move it back.

The invention will be explained in more detail using one exemplary embodiment and with reference to the drawings, in which.

DETAILED DESCRIPTION OF THE INVENTION

Figure 1:
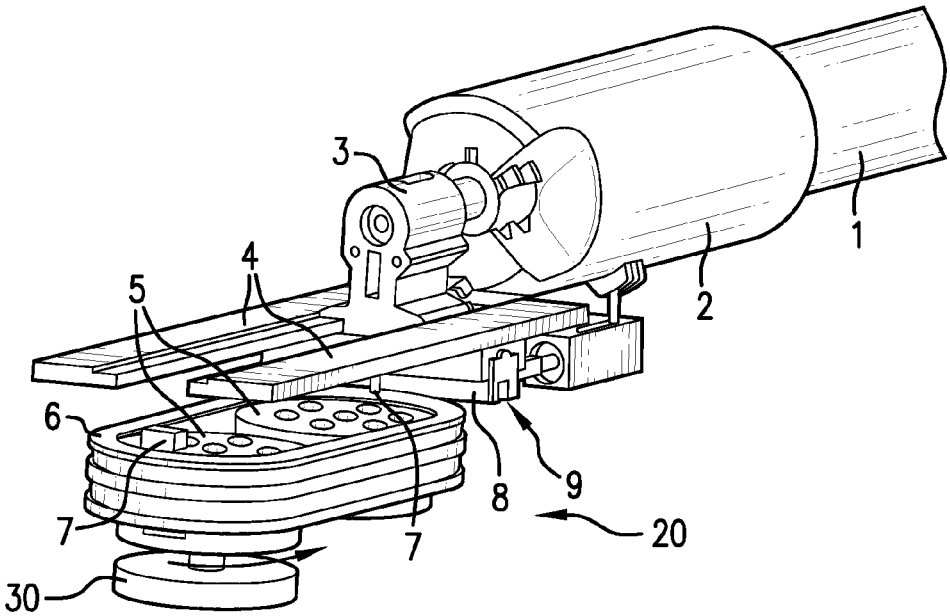
FIG. 1 shows a slightly perspective illustration of a drive for an externally driven weapon in accordance with the present invention.
Figure 5:
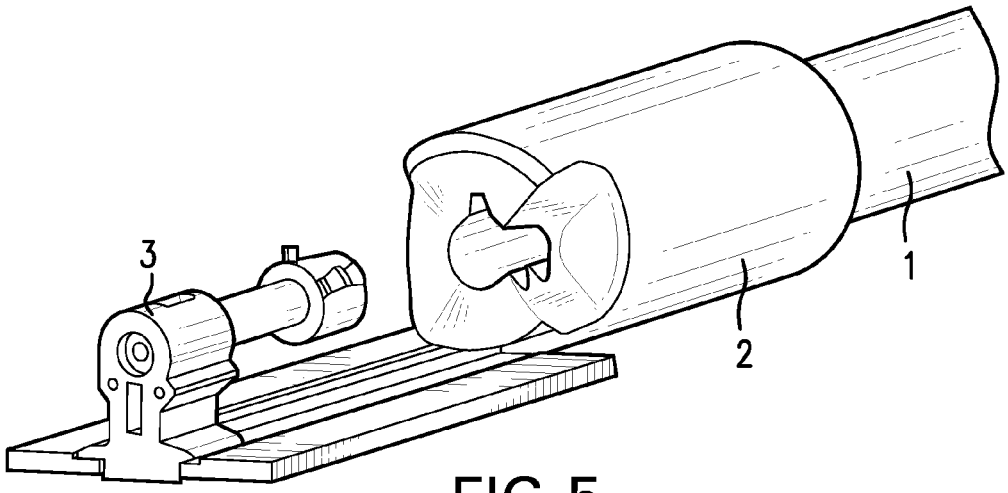
FIG. 5 shows the breech 3 in its rear position.

FIG. 1 shows an illustration of a breech drive 20 provided with a chain 6 for an externally driven machine gun (partially illustrated), and associated with a weapon barrel 1 that is mounted in a barrel lock (in this case, a locking bush), in which a breech 3 is also locked in its front position. The breech 3 can be moved on breech guides 4 in and counter to the weapon barrel axis (i.e., back and forth along the axis defined by the breech guides 4). FIG. 1 shows the breech 3 in its front position and FIG. 5 shows the breech 3 in its rear position.

As evident from FIGS. 1, 2, 3 and 5, the breech interacts with the barrel lock 2 as follows. The breech 3 is provided with catch bumps so that when the breech 3 is driven into the barrel lock 2, the locking bush of the barrel lock 2 is rotated so that bumps of the locking bush are disposed behind catch bumps of the breech 3 so that these respective parts catch one another, thereby creating an actuated connection. To unlock the socket of the locking bush of the barrel lock 2 from the breech 3, the locking bush is either turned back to a release position or turned further until the release position is reached, which allows the socket to release the catch bumps of the breech 3 again so that the breech 3 can be driven out of the barrel lock 2 as shown in FIG. 5. In front of the breech 3, in the firing direction, a cartridge (not shown) to be fired is disposed when the breech is in the rear position. The cartridge is smaller in cross section than the cross section of the breech 3, and the cartridge is pushed centrically by a portion of the barrel lock 2 into the cartridge chamber of the weapon barrel 1, which is securely closed by the breech 3 when the breech 3 is in the front position (FIG. 1).

Two sprocket wheels 5 and the chain 6, provided with preferably two driver studs 7, are preferably arranged underneath the breech guides 4 or the breech 3 (offset by 180° with respect to one another). A slide 8 is mounted in a guide located at the bottom on the breech 3 (or breech holder) such that the slide 8 can be moved transversely with respect to the firing direction of the weapon, and a groove 9 extends over the entire width of this slide 8. Via this groove 9, the respective driver stud 7 moves the breech 3 forward in the firing direction, or back in the opposite direction after the shot is fired.

One of the sprocket wheels 5 is driven by a motor 30, or the like (directly or indirectly), and drives the chain 6 such that the chain 6 is moved forward on the right-hand side of the weapon, and back on the left-hand side, as viewed from the firing direction. Alternatively, the entire movement can also take place in the opposite direction to this described direction (i.e., the structure may be reversed so that the chain 6 is moved forward on the left-hand side of the weapon, and back on the right-hand side, as viewed from the firing direction).

In order to transport the breech 3 forward, the driver stud 7 located on the right-hand weapon side is threaded into the groove 9 of the slide 8. This results in an interlocking connection, in the longitudinal direction of the weapon, between the drive 20 and the breech 3, with the breech 3 being accelerated or braked via a sinusoidal function (i.e., in a sinusoidal manner), which is predetermined by the radius of the sprocket wheels 5.

Figure 6:
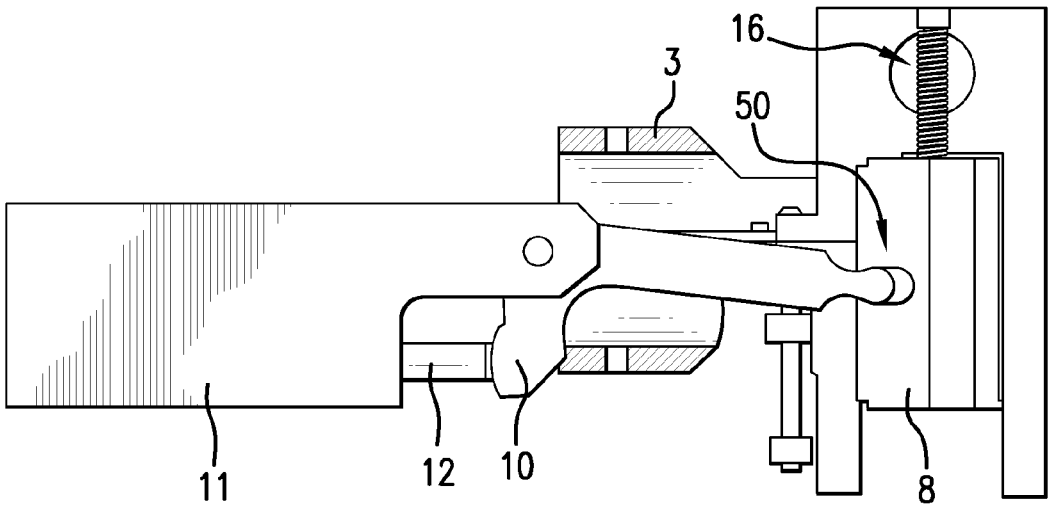
FIG. 6 shows the slide 8 in the left-hand position.

The times during which the breech 3 is stationary and located in the front limit position are implemented in that the driver stud 7 is moved out of the groove 9 and is moved backward on the left-hand side of the weapon without the breech 3. That is, during the time when the breech 3 is the front, locked position, the driver stud 7 is not in the groove 9, but is moved backwards and away from the breech 9. When the breech 3 is in the front, locked position, a firing bolt (not illustrated in any more detail) is released in a known manner, by which means a cartridge located in the cartridge chamber (neither is illustrated in any more detail) is fired. The weapon recoil, which then occurs, is used to move the slide 8 to the left-hand side of the weapon (See FIG. 6). Alternatives for moving the slide 8 to the left-hand side of the weapon are possible within the scope of the invention, such as those alternatives that use the build-up of gas pressure on firing.

Figure 2:
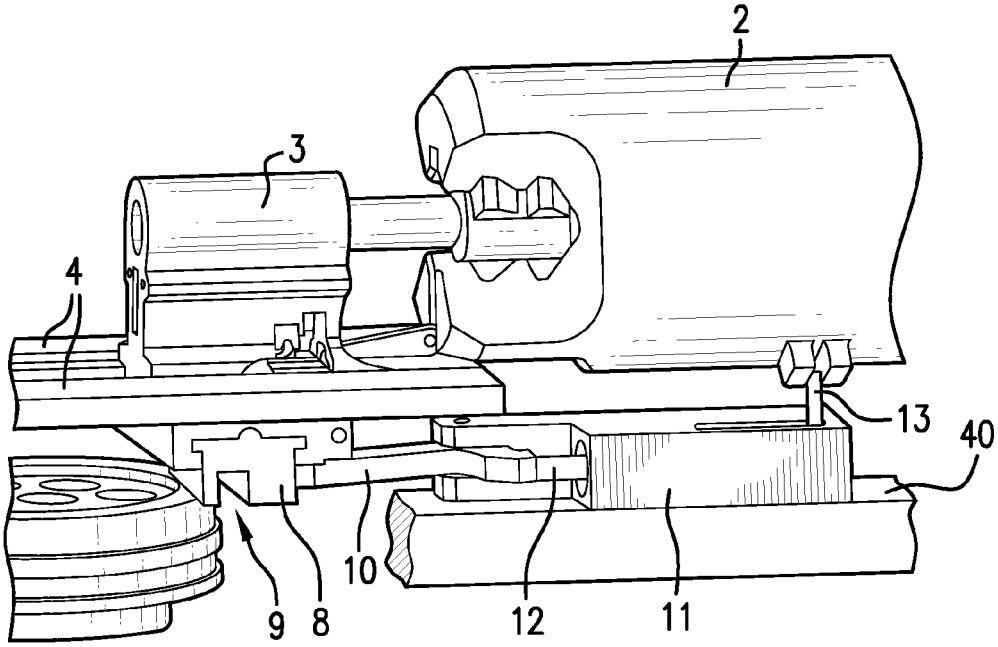
FIG. 2 shows a side view of FIG. 1.
Figure 3:
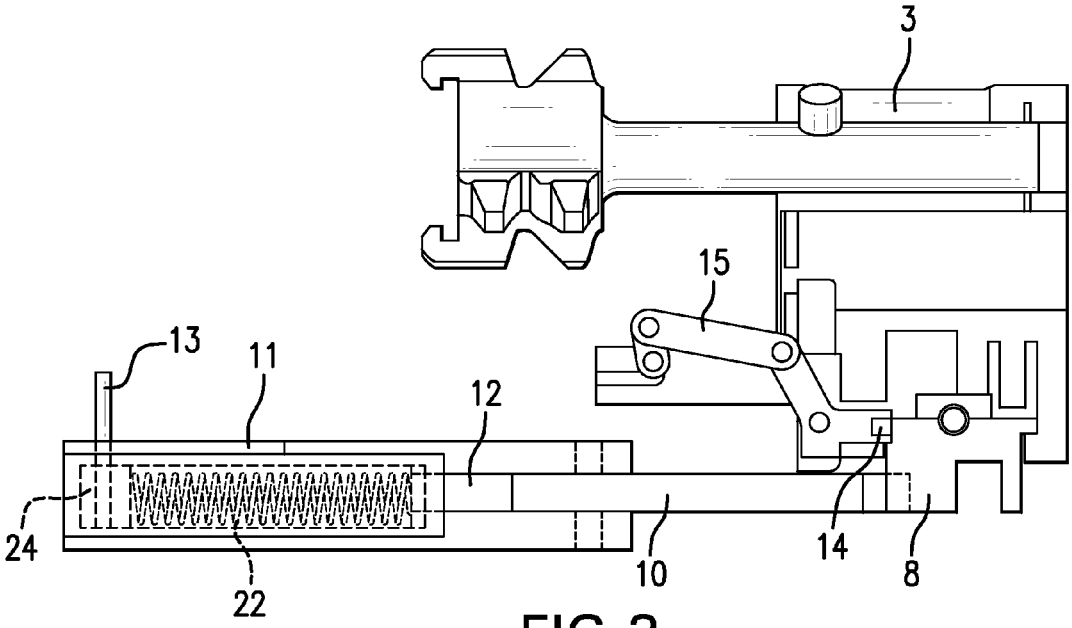
FIG. 3 shows a view from the left, with the major assemblies illustrated, of a drive for an externally driven weapon in accordance with the present invention.
Figure 4:
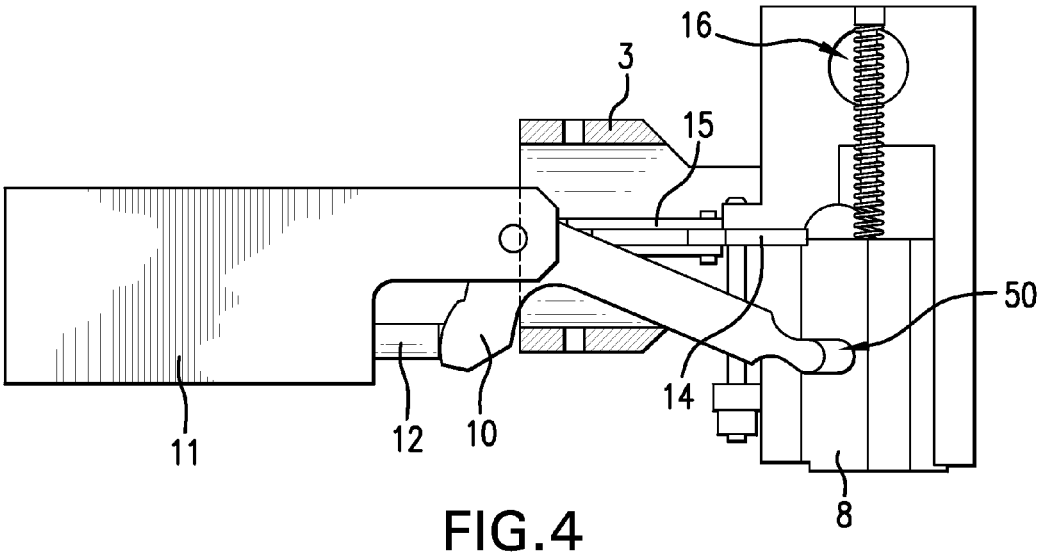
FIG. 4 shows a view from below, with the major assemblies shown, of a drive for an externally driven weapon in accordance with the present invention.

The elements 10 to 15, which are required for operation of the drive, are shown by way of example in FIGS. 2 to 4, in particular, taking account of the possible use of gas pressure. A lever 10 moves the slide 8 to its left-hand position (FIG. 6), and, in the process, stresses a compression spring 16, during the weapon recoil. The recoil movement is transmitted from the weapon barrel 1 to the barrel lock 2, which drives a pin 13. The pin 13 and a plunger 12 are arranged in a bearing block 11, which is fixed to the weapon housing 40, such that they can be moved in the longitudinal direction parallel to the firing direction of the weapon. FIG. 3 shows a spring 22 between a sleeve 24, in which the pin 13 is mounted, and the plunger 12. The weapon recoil is, therefore, not converted in a rigidly coupled form to a rotary movement of the lever 10, but instead is buffered via the spring 22. This structure, therefore, ensures that the slide 8 is always moved completely onto the left-hand side, even when weapon recoils of different length occur.

During weapon recoil, a linkage 15 is moved by the rear edge of the barrel lock 2 and rotates the lever 10, thus removing the lock from the slide 8, which holds (locks) the slide 8 in its right-hand or left-hand position, by means of a tab 50, when in its rest position. After the weapon barrel has recoiled (i.e., a shot is fired), the slide 8 is now located on the left-hand side of the weapon and is held in this position by the lever 10, against the pressure from the spring 16. The next driver stud 7 now runs from the right-hand side into the groove 9, and drives the breech 3 to its rear position. In this rear position, the stud 7 leaves the groove 9, as a result of which the breech 3 is once again detached from the chain 6 of drive 20, and remains in its position.

After a new cartridge has been fed upstream of the breech 3, an element of the feeder (not illustrated in any more detail), for example, actuates the lever 14, as a result of which the locking of the slide 8 is canceled. Thus, the slide 8 is unlocked. The unlocked slide 8 is then moved by the spring 16 back to the right-hand side of the weapon (See FIGS. 1 and 4), as a result of which the next driver stud 7 drives the breech 3 forward again to the front position. Thus, in accordance with the present invention, the quick stop mechanism is provided by the lever 14, the slide 8, and associated structures connected to the breech 3.

However, if there is no weapon recoil, because no shot has been fired, the slide 8 remains in the front position on the right-hand side of the weapon, and the second or subsequent driver stud 7 cannot unlock the breech 3 and drive it back to the rear position.

The invention claimed is:

1. A drive provided with a quick stop device operably connected to a breech, or a breech support, of a weapon, wherein the breech or breech support is moveable between a front limit position and a rear position in an axial direction with respect to a weapon barrel of the weapon, wherein the drive comprises:

(a) a motor;

(b) a chain that is driven by the motor and to which at least two driver studs are fitted;

(c) at least two sprocket wheels arranged underneath the breech, wherein the chain with the at least two driver studs is passed around the at least two sprocket wheels;

(d) a slide mounted in a guide disposed at a bottom on the breech, or at a bottom on the breech support, so that the slide is moveable transversely with respect to a firing direction, and a groove extends over the entire width of the slide, wherein a respective one of the at least two driver studs moves the breech via the groove either forward in the firing direction or backward after a shot is fired, wherein during times in which the breech is stationary in the front limit position, the driver stud that transports the breech forward is moved out of the groove and the driver stud is moved backward on a first weapon side and without the breech, and when a shot has been fired, the slide moves to the first weapon side, and when no shot has been fired, the slide remains in a first position in which the slide has been moved away from the driver stud so that neither driver stud is in position to drive the breech to the rear position.

2. The drive as claimed in claim 1, wherein one of the at least two sprocket wheels is driven by the motor, either directly or indirectly, and the one sprocket wheel driven by the motor drives the chain.

3. The drive as claimed in claim 1, wherein the breech is accelerated or braked in accordance with movement defined by a sinusoidal function, wherein the sinusoidal function is predetermined by a radius of the at least two sprocket wheels.

4. The drive as claimed in claim 1, wherein a lever moves the slide to a left-hand position, and in the process of moving the slide to the left-hand position the lever stresses a compression spring.

5. The drive as claimed in claim 1, wherein a recoil movement of the weapon barrel acts on a barrel lock of the weapon so that the barrel lock drives a pin that is arranged to be moveable in a longitudinal direction, together with a plunger, in a bearing block that is fixed to a weapon housing.

6. The drive as claimed in claim 5, wherein a spring is included between a sleeve and the plunger, wherein the pin is mounted in the sleeve.

7. The drive as claimed in claim 5, wherein a linkage is moved by a rear edge of the barrel lock during weapon recoil, and the linkage rotates the lever thus removing a lock from the slide that holds the slide in a right-hand position or a left-hand position, in a rest position, by means of a tab.

8. The drive as claimed in claim 2, wherein the breech is accelerated or braked in accordance with movement defined by a sinusoidal function, wherein the sinusoidal function is predetermined by a radius of the at least two sprocket wheels.

9. The drive as claimed in claim 8, wherein a lever moves the slide to a left-hand position, and in the process of moving the slide to the left-hand position the lever stresses a compression spring.

10. The drive as claimed in claim 2, wherein a lever moves the slide to a left-hand position, and in the process of moving the slide to the left-hand position the lever stresses a compression spring.

11. The drive as claimed in claim 3, wherein a lever moves the slide to a left-hand position, and in the process of moving the slide to the left-hand position the lever stresses a compression spring.

12. The drive as claimed in claim 6, wherein a linkage is moved by a rear edge of the barrel lock during weapon recoil, and the linkage rotates the lever thus removing a lock from the slide that holds the slide in a right-hand position or a left-hand position, in a rest position, by means of a tab.

* * * * *